US010383179B2

(12) United States Patent
Chiang

(10) Patent No.: US 10,383,179 B2
(45) Date of Patent: Aug. 13, 2019

(54) CRUCIBLE DEVICE WITH TEMPERATURE CONTROL DESIGN AND TEMPERATURE CONTROL METHOD THEREFOR

(71) Applicant: METAL INDUSTRIES RESEARCH & DEVELOPMENT CENTRE, Kaohsiung (TW)

(72) Inventor: Chen-Hsueh Chiang, Kaohsiung (TW)

(73) Assignee: METAL INDUSTRIES RESEARCH & DEVELOPMENT CENTRE, Kaohsiung (TW)

( * ) Notice: Subject to any disclaimer, the term of this patent is extended or adjusted under 35 U.S.C. 154(b) by 427 days.

(21) Appl. No.: 15/370,475

(22) Filed: Dec. 6, 2016

(65) Prior Publication Data

US 2018/0160486 A1 Jun. 7, 2018

(51) Int. Cl.
*F27D 3/00* (2006.01)
*H05B 6/06* (2006.01)
(Continued)

(52) U.S. Cl.
CPC ..... *H05B 6/067* (2013.01); *F27B 14/063* (2013.01); *F27B 14/0806* (2013.01); *F27B 14/10* (2013.01); *F27B 14/14* (2013.01); *F27B 14/20* (2013.01); *F27D 3/14* (2013.01); *F27D 11/06* (2013.01); *F27D 19/00* (2013.01); *F27D 21/0014* (2013.01); *H05B 6/367* (2013.01); *F27B 2014/0818* (2013.01); *F27D 2019/0003* (2013.01)

(58) Field of Classification Search
CPC . H05B 6/02; H05B 6/067; H05B 6/22; H05B 6/24; H05B 6/34; H05B 6/36; H05B 6/367; H05B 6/42; F27D 11/06; F27D 21/0014; F27D 21/0028; F27D 19/00; F27D 3/0027; F27D 3/14; F27D 3/15; F27D 3/1509; F27D 3/1518; F27D 3/1527; F27D 2019/0003; F27B 14/04; F27B 14/061; F27B 14/063; F27B 14/065; F27B 14/0806; F27B 14/10; F27B 14/14; F27B 14/20; F27B 2014/0818; F27B 2014/102
USPC ..... 373/138, 139, 142, 143, 144, 151, 155, 373/156
See application file for complete search history.

(56) References Cited

U.S. PATENT DOCUMENTS 4,471,488 A * 9/1984 Reboux ..... C03B 5/021 373/153
5,479,438 A * 12/1995 Blum ..... B22D 41/14 373/142
(Continued)

*Primary Examiner* — Hung D Nguyen
(74) *Attorney, Agent, or Firm* — Juan Carlos A. Marquez; Marquez IP Law Office, PLLC

(57) ABSTRACT

A crucible device with temperature control design includes a crucible body, an induction coil unit, a nozzle flange body and a melt delivery tube and a temperature control unit. The induction coil unit surrounds the crucible body, provides a heat source during use, and is configured to enable a metal material to melt and produce a melt having a melting skull. The melt delivery tube is communicated via the nozzle flange body to a bottom of the crucible body and is configured to deliver the melt from the crucible body. The temperature control unit includes a microprocessor, a heater and a temperature sensor which are electrically coupled to each other, and are configured to control a curve of the melting skull to drop to a preset position.

10 Claims, 4 Drawing Sheets

(51) Int. Cl.

| | |
|---|---|
| ***F27D 11/06*** | (2006.01) |
| ***F27D 21/00*** | (2006.01) |
| ***F27D 19/00*** | (2006.01) |
| ***F27D 3/14*** | (2006.01) |
| ***F27B 14/20*** | (2006.01) |
| ***F27B 14/14*** | (2006.01) |
| ***F27B 14/10*** | (2006.01) |
| ***F27B 14/08*** | (2006.01) |
| ***F27B 14/06*** | (2006.01) |
| ***H05B 6/36*** | (2006.01) |

(56) References Cited

U.S. PATENT DOCUMENTS 6,144,690 A * 11/2000 Kusamichi ..... C22B 9/003
373/142
6,219,372 B1 * 4/2001 Zabala ..... F27B 14/063
373/142
2001/0022801 A1 * 9/2001 Tsuda ..... F27B 14/063
373/142
2013/0182740 A1 * 7/2013 Kim ..... F27B 14/063
373/142
2015/0098484 A1 * 4/2015 Cho ..... H05B 6/34
373/142

* cited by examiner

CRUCIBLE DEVICE WITH TEMPERATURE CONTROL DESIGN AND TEMPERATURE CONTROL METHOD THEREFOR

BACKGROUND

Technical Field

The present disclosure relates to a crucible device with temperature control design and a temperature control method therefor, and more particularly, to a crucible device having a melting skull with temperature control design and a temperature control method therefor.

Related Art

As shown in FIG. 1, the problem related to skull breaking may occur in a conventional water-cooled copper crucible 9. A melt 92 that has been melted and is above a melting skull 91 is of a fine crystal particle area 93 and the melt 92 that has not been melted and is below the melting skull 91 is of a crude crystal particle area 94, resulting in that the melt 92 that has been melted cannot smoothly flow out.

To resolve the problem related to skull breaking of the water-cooled copper crucible 9, as shown in FIG. 2, a ceramic heat insulation ring 95 is disposed in the water-cooled copper crucible 9, and is located between a crucible body 96 and a nozzle flange body 97 of the water-cooled copper crucible 9, to prevent heat of the nozzle flange body 97 from being dissipated to a water-cooled crucible body. In this matter, a curve of the melting skull 91 drops to positions close to two sides of the nozzle flange body 97, such that the melt 92 that has been melted can smoothly flow out.

Although the problem related to skull breaking of a conventional water-cooled copper crucible is resolved, an excessively high temperature of the melt may cause compound reaction between the nozzle flange body and the melt. For example, the temperature at which a nozzle flange body made of graphite reacts with a titanium melt to produce a compound is approximately greater than 1050 degrees Celsius. If the temperature of the melt near the nozzle flange body exceeds 1050 degrees Celsius, the graphite reacts with titanium to produce a TiC compound, thereby influencing the quality of the titanium melt. In addition, the temperature of the melt is not controlled within a desired temperature range, and the temperature of the melt changes dramatically in different melting processes. For example, a difference in the temperature of a titanium melt in different melting processes may be greater than 300 degrees Celsius. In this manner, the curve of the melting skull of the melt may become uncontrollable, thereby influencing the casting quality of subsequent processes.

In view of this, a crucible device with temperature control design applicable to a melting skull and a temperature control method for the melting skull need to be provided to resolve the foregoing problem.

SUMMARY

A major objective of the present disclosure lies in providing a crucible device with temperature control design and a temperature control method therefor, used to control a curve of a melting skull to drop to a preset position, so as to maintain the quality of the melt and increase the utilization rate of the melt while breaking a skull.

To achieve the above objective, the present disclosure provides a crucible device with temperature control design, the crucible device including: a crucible body; an induction coil unit, surrounding the crucible body, providing a heat source during use, and configured to enable a metal material to melt and produce a melt having a melting skull; a nozzle flange body and a melt delivery tube, wherein the melt delivery tube is communicated to a bottom of the crucible body via the nozzle flange body, and is configured to deliver the melt from the crucible body; and a temperature control unit, including a microprocessor, a heater, and a temperature sensor that are electrically coupled to each other, wherein: the temperature sensor is configured to measure a temperature of a boundary of the nozzle flange body which is close to the melt, the heater is configured to inductively heat the nozzle flange body, the microprocessor adjusts power of the heater according to the measured temperature of the boundary of the nozzle flange body, so as to control the temperature of the boundary of the nozzle flange body to reach a predetermined temperature, and to further control a curve of the melting skull to drop to a preset position.

If the temperature of the melting skull of the melt (for example, titanium) is more than the temperature at which the nozzle flange body (for example, graphite) reacts with the melt to produce a compound, preferably, the predetermined temperature is less than and close to the temperature at which the nozzle flange body reacts with the melt to produce a compound. The temperature of the boundary of the nozzle flange body (controlled as the predetermined temperature) is controlled to be less than the temperature at which the nozzle flange body reacts with the melt to produce a compound, and therefore the predetermined temperature of the nozzle flange body can prevent the nozzle flange body from reacting with the melt to produce a compound, thereby guaranteeing the quality of the melt.

If the temperature of the melting skull of the melt (for example, titanium) is less than the temperature at which the nozzle flange body (for example, tungsten steel) reacts with the melt to produce a compound, preferably, the predetermined temperature is less than and close to the temperature of the melting skull of the melt. The predetermined temperature is less than and close to the temperature of the melting skull of the melt, and therefore, the curve of the melting skull of the melt can become closer to two sides of the nozzle flange body. The utilization rate of the melt is increased when the curve of the melting skull of the melt becomes closer to the two sides of the nozzle flange body.

To make the foregoing and other objectives, features, and advantages of the present disclosure more evident, detailed description is made hereinafter as follows with reference to the accompanying drawings.

DETAILED DESCRIPTION

Figure 1:
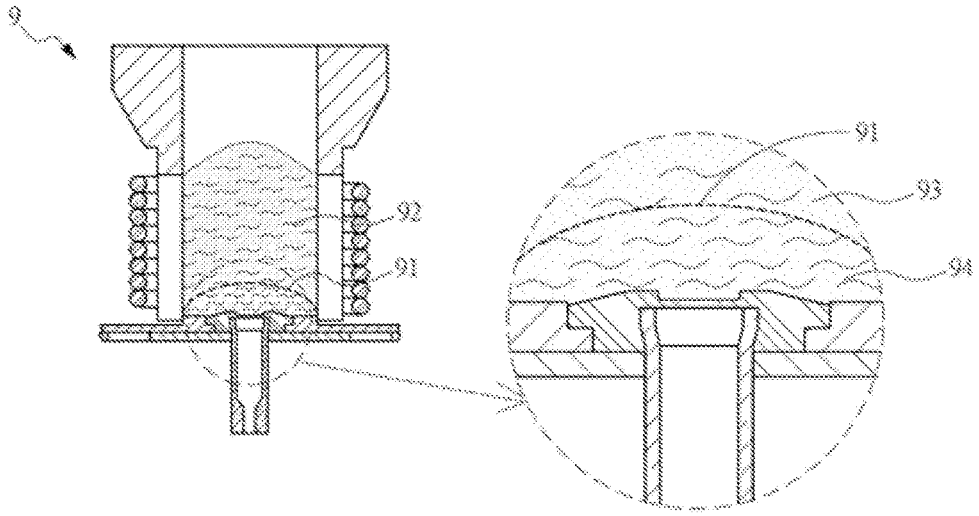
FIG. 1 (PRIOR ART)
FIG. 1 is a schematic sectional view of a conventional water-cooled copper crucible.
Figure 2:
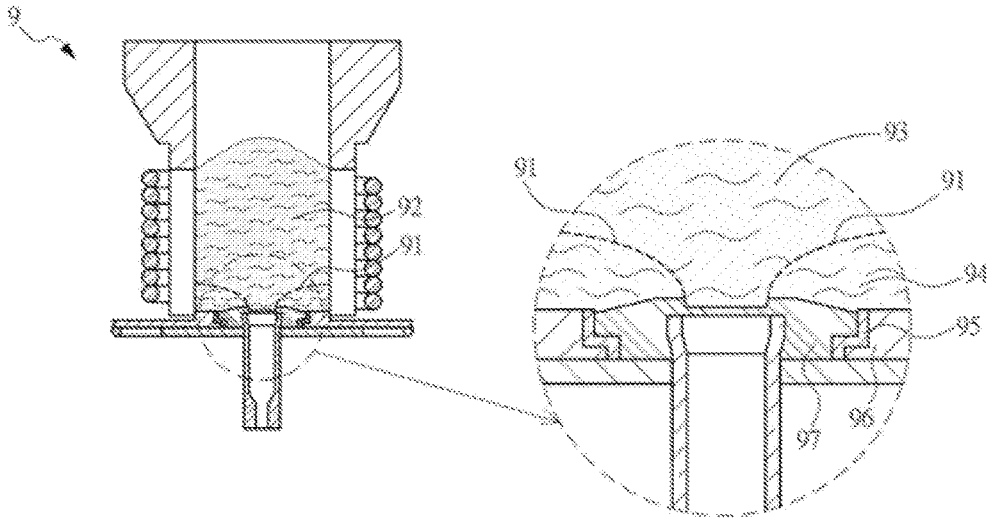
FIG. 2 (PRIOR ART)
FIG. 2 is a schematic sectional view of another conventional water-cooled copper crucible and is illustrative of a ceramic heat insulation ring disposed in the another conventional water-cooled copper crucible.
Figure 3:
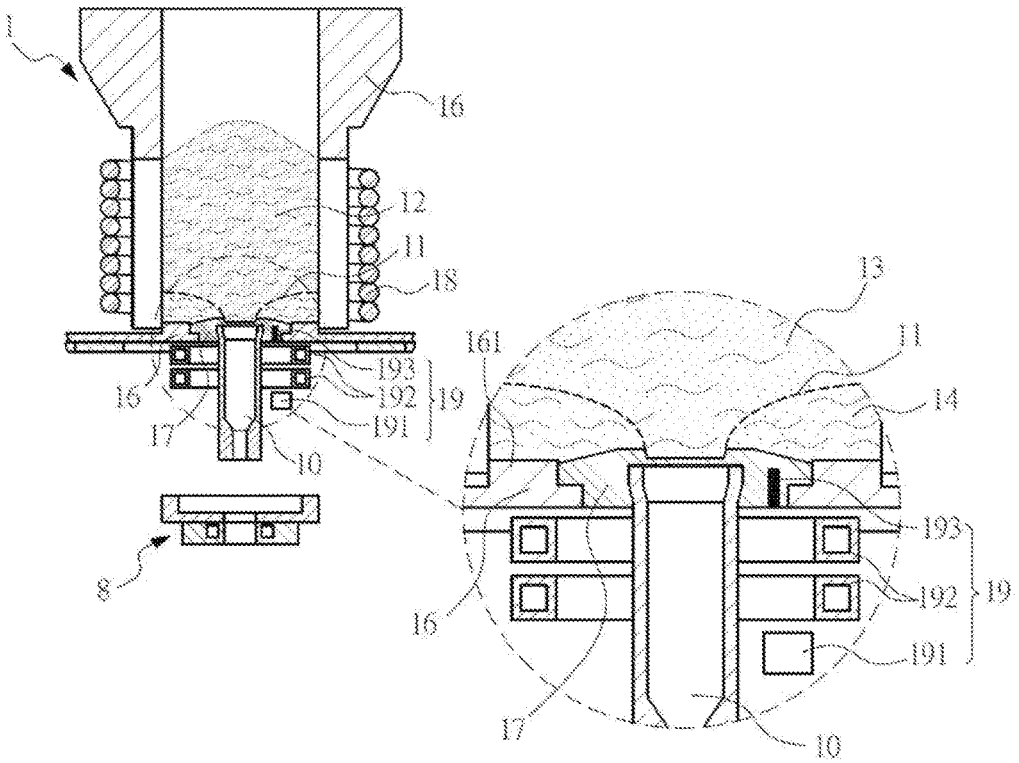
FIG. 3 is a schematic sectional view of a crucible device having a melting skull with temperature control design according to a first embodiment of the present disclosure.

Referring to FIG. 3, FIG. 3 shows a crucible device 1 having a melting skull with temperature control design according to a first embodiment of the present disclosure. The crucible device 1 is configured to manufacture a melt 12. The melt 12 can be applied to a casting process, for example, the melt 12 is transmitted to a casting mold 8. In this embodiment, the melt 12 being a titanium melt is used as an example for description below.

The crucible device 1 includes: a crucible body 16, an induction coil unit 18, a temperature control unit 19, a nozzle flange body 17, and a melt delivery tube 10.

The crucible body 16 is a water-cooled crucible body. The induction coil unit 18 surrounds the crucible body 16 and provides a heat source during use. The induction coil unit 18 is configured to enable a metal material to melt and produce a melt having a melting skull. For example, the induction coil unit 18 inductively heats a metal material rod inside the crucible body 16, to produce a melt 12. In this embodiment, the melt 12 inside the crucible body 16 can be produced by inductively heating an active metal material rod (for example, a titanium material rod) by means of an induction coil (for example, at 30 KW, 8 kHz) of a high frequency coil. As the crucible body 16 is of water-cooled design, a melting skull 11 can be formed in the melt 12. The melt 12 that has been melted and is above the melting skull 11 is of a fine crystal particle area 13, and the melt 12 that has not been melt and is below the melting skull 11 is of a crude crystal particle area 14.

The melt delivery tube 10 is communicated to a bottom 161 of the crucible body 16 via the nozzle flange body 17, and is configured to deliver the melt 12 from the crucible body 16. The melt delivery tube 10 can be made of a heat resistant material such as graphite and tungsten steel. In this embodiment, the nozzle flange body 17 is made of a heat resistant material of graphite.

The temperature control unit 19 includes a microprocessor 191, a heater 192, and a temperature sensor 193 that are electrically coupled to each other. For example, the microprocessor 191 is electrically connected to the heater 192 and the temperature sensor 193. The temperature sensor 193 is configured to measure a temperature of a boundary of the nozzle flange body 17, which is close to the melt 12. The heater 192 is configured to inductively heat the nozzle flange body 17. The microprocessor 191 adjusts a power of the heater 192 according to the measured temperature of the boundary of the nozzle flange body 17, to control the temperature of the boundary of the nozzle flange body 17 to reach a predetermined temperature, and to further control a curve of the melting skull 11 to drop to a preset position, so as to maintain the quality of the melt 12 and increase the utilization rate of the melt 12 while breaking the skull. For example, the temperature sensor 193 can be a thermo couple, the thermo couple being directly embedded in the nozzle flange body 17. The temperature sensor 193 is configured to measure the temperature of the boundary of the nozzle flange body 17. The heater 192 is a power-adjustable induction coil, and is configured to inductively heat the nozzle flange body 17, so that the temperature of the boundary thereof reaches the predetermined temperature. For example, if the power of the induction coil is 5 KW, the temperature of the boundary of the nozzle flange body 17 reaches 1000 degrees Celsius; if the power of the induction coil is 6 KW, the temperature of the boundary of the nozzle flange body 17 reaches 1100 degrees Celsius, or the like. The induction coil is a high frequency coil, for example, at 400 KHz. The microprocessor 191 can further include a proportional integral derivative (PID) controller, configured to output a power of the induction coil according to the predetermined temperature, and to inductively heat the nozzle flange body 17 so that the temperature of the boundary thereof reaches the predetermined temperature.

Figure 4:
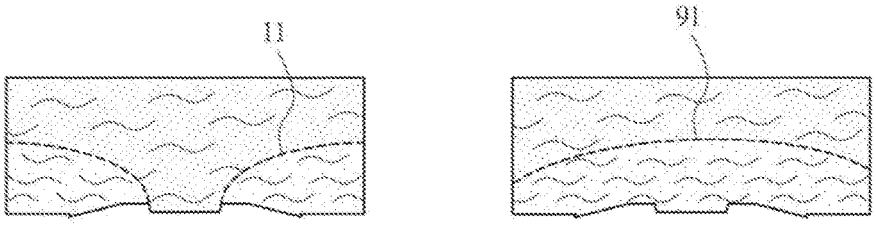
FIG. 4 is a comparison diagram of curves of a melting skull with temperature control design (the left figure) and without temperature control design (the right figure) according to the first embodiment of the present disclosure.

A lower limit value of a predetermined temperature T0 of the nozzle flange body 17 is more than or equal to a basic temperature T1 for breaking of the melting skull 11 of the melt 12. The basic temperature T1 indicates a temperature that is less than a temperature T2 of the melting skull 11 of the melt 12 by a temperature drop gradient of approximately 200 degrees Celsius (for example, the temperature of the melting point of titanium is about 1680 degrees Celsius, and the temperature T2 of the melting skull 11 of the titanium melt is approximately 1200 degrees Celsius; if the predetermined temperature T0 of the nozzle flange body 17 exceeds the basic temperature T1, 1000 degrees Celsius, a center of the curve of the melting skull 11 can move downwards to generate skull breaking). Therefore, the melting skull 11 can be broken when the predetermined temperature T0 of the nozzle flange body 17 is more than a temperature obtained after subtracting the temperature T2 of the melting skull 11 of the melt 12 by 200 degrees Celsius (that is, $T0 \geq T1 = T2 - 200$). FIG. 4 is a comparison diagram of curves of a melting skull with temperature control design (shown in the left figure) and without temperature control design (shown in the right figure) according to the first embodiment of the present disclosure. As shown in the left figure, the temperature control design enables the predetermined temperature T0 of the nozzle flange body 17 to exceed the basic temperature T1, in addition to downward motion of the center of the curve of the melting skull 11 to generate skull breaking, left half and right half sections of the curve of the melting skull 11 also drop to positions close to two sides of the nozzle flange body 17, such that the melt 12 that has been melted can smoothly flow out. However, no skull breaking occurs in the melting skull 91 of the prior art shown in the right figure. In another embodiment, if the melt 12 is replaced with another metal material melt apart from the titanium melt, the lower limit value of the predetermined temperature T0 is adjusted according to a difference in the material of the melt. The lower limit value is calculated mainly according to experimental results of temperature gradients.

However, if the temperature of the melting skull 11 of the melt 12 is more than the temperature at which the nozzle flange body 17 reacts with the melt 12 to produce a compound, an upper limit value of the predetermined temperature of the nozzle flange body 17 needs to be the temperature at which the nozzle flange body 17 reacts with the melt 12 to produce a compound (for example, the temperature at which the nozzle flange body 17 made of graphite reacts with the titanium melt to produce a compound is approximately 1050 degrees Celsius or above). Preferably, the predetermined temperature is less than or close to the temperature at which the nozzle flange body 17 reacts with the melt 12 to produce a compound. For example, the predetermined temperature is less than and close to 1050 degrees Celsius. The temperature of the boundary of the nozzle flange body 17 (controlled as the predetermined temperature) is controlled to be less than the temperature at which the nozzle flange body 17 reacts with the titanium melt to produce a compound, and therefore the predetermined temperature of the nozzle flange body 17 can prevent the graphite from reacting with the titanium to produce a compound, TiC, thereby guaranteeing the quality of the melt 12.

In addition, as the temperature of the boundary of the nozzle flange body 17 is controlled as the predetermined temperature, further the temperature of the melt is also controlled within a desired temperature range, a change in the temperature of the melt in different melting processes is quite small. For example, a difference in the temperature of the titanium melt in different melting processes is less than 50 degrees Celsius. In this manner, the curve of the melting skull of the melt 12 can become controllable, thereby improving the casting quality of subsequent processes.

Again referring to FIG. 3, in another embodiment, the nozzle flange body 17 is made of a heat resistant material of tungsten steel. If the temperature of the melting skull of the melt 12 is less than the temperature at which the nozzle flange body 17 reacts with the melt 12 to produce a compound, the upper limit value of the predetermined temperature of the nozzle flange body 17 can be the temperature of the melting skull 11 of the melt 12. Preferably, the predetermined temperature is less than and close to the temperature of the melting skull 11 of the melt 12. For example, the temperature of the melting skull of the titanium melt (approximately 1200 degrees Celsius) is less than the temperature at which the nozzle flange body 17 made of tungsten steel reacts with the melt 12 to produce a compound. As the predetermined temperature is less than and close to the temperature of the melting skull of the titanium melt (approximately 1200 degrees Celsius), the left half and right half sections of the curve of the melting skull 11 of the titanium melt can become closer to the two sides of the nozzle flange body 17. When the left half and right half sections of the curve of the melting skull 11 of the melt 12 becomes closer to the two sides of the nozzle flange body 17, a fine crystal particle area 13 of the melt 12 that has been melted and is above the melting skull 11 becomes larger, and a crude crystal particle area 14 of the melt 12 that has not been melt and is below the melting skull 11 becomes smaller, such that the utilization rate of the melt 12 can be increased. However, the melting skull 11 is still needed to serve as a protection layer.

Figure 5:
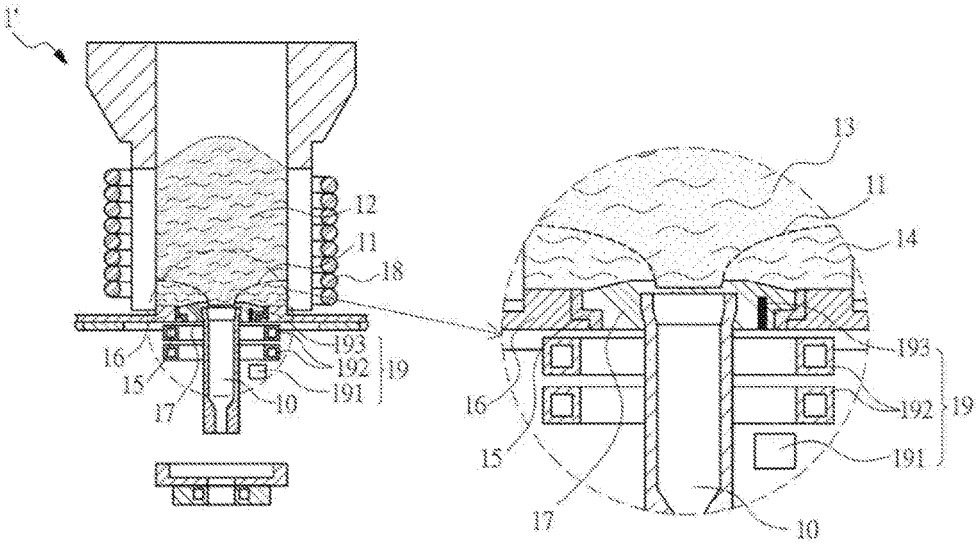
FIG. 5 is a schematic sectional view of a crucible device having a melting skull with temperature control design according to a second embodiment of the present disclosure.
Figure 6:
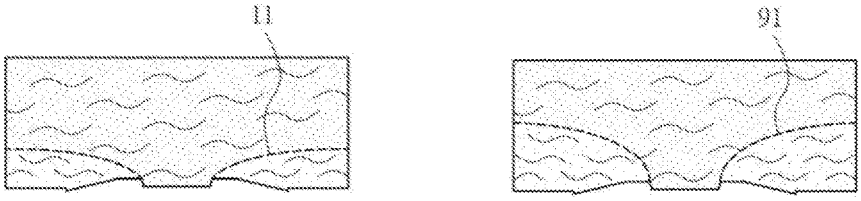
FIG. 6 is a comparison diagram of curves of a melting skull with temperature control design (the left figure) and without temperature control design (the right figure) according to the second embodiment of the present disclosure.

Referring to FIG. 5, FIG. 5 shows a schematic diagram of a crucible device having a melting skull with temperature control design according to a second embodiment of the present disclosure. The difference between the first and second embodiments lies in that: in the second embodiment, a crucible device 1' further includes a heat insulation ring 15, located between the crucible body 16 and the nozzle flange body 17, and configured to alleviate heat dissipation from the nozzle flange body 17 to the crucible body 16. The heat insulation ring 15 can be made of a ceramic material. The temperature control unit 19 also includes a microprocessor 191, a heater 192, and a temperature sensor 193. The temperature sensor 193 is configured to measure a temperature of a boundary of the nozzle flange body 17 which is close to the melt 12. The heater 192 is configured to inductively heat the nozzle flange body 17. The microprocessor 191 adjusts power of the heater 192 according to the measured temperature of the boundary of the nozzle flange body 17, to control the temperature of the boundary of the nozzle flange body 17 to reach a predetermined temperature, so as to guarantee the quality of the melt 12 and assist to implement breaking of the melting skull of the melt 12. The heat dissipation from the nozzle flange body 17 to the crucible body can be alleviated, and therefore, the boundary of the nozzle flange body 17 can be heated by using a relatively small power, to reach the predetermined temperature. FIG. 6 is a comparison diagram of curves of a melting skull with temperature control design (shown in the left figure) and without temperature control design (shown in the right figure) according to the second embodiment of the present disclosure. As shown in FIG. 6, the temperature control design enables left half and right half sections of the curve of the melting skull 11 to drop to positions closer to two sides of the nozzle flange body 17.

Figure 7:
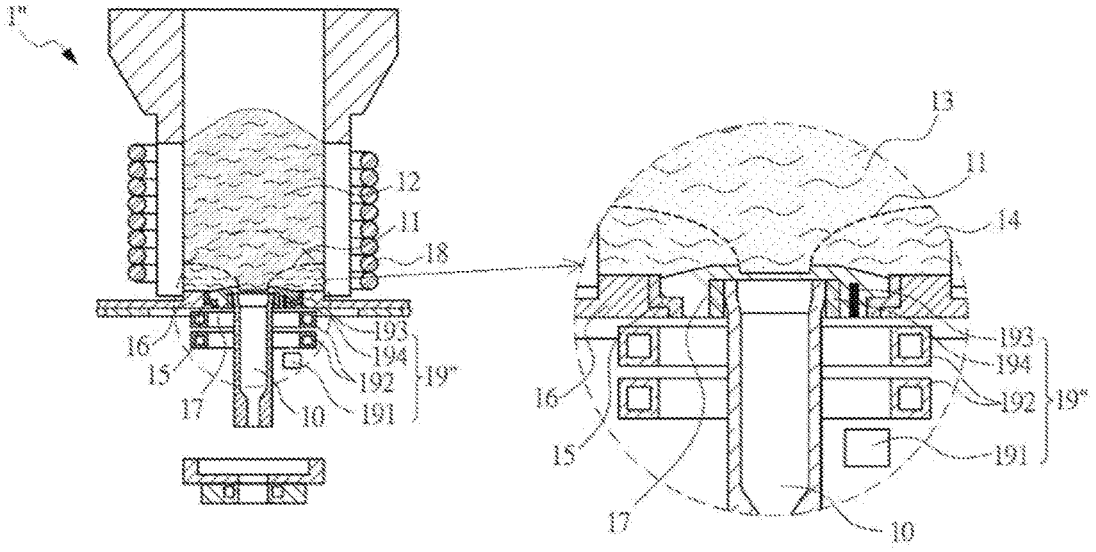
FIG. 7 is a schematic sectional view of a crucible device having a melting skull with temperature control design according to a third embodiment of the present disclosure.

Referring to FIG. 7, FIG. 7 shows a schematic diagram of a crucible device 1" with temperature control design and having a melting skull according to a third embodiment of the present disclosure. The difference between the third and second embodiments lies in that: in the third embodiment, the temperature control unit 19" further includes a cooling water passage 194, configured to remove heat from the nozzle flange body. The temperature control unit 19" having the cooling water passage 194 and the heater 192 can enable the temperature of the boundary of the nozzle flange body 17 to reach the predetermined temperature more rapidly and more precisely.

In addition, the present disclosure further provides a temperature control method for a melting skull. The method includes the following steps: providing a crucible body, a nozzle flange body, and a melt delivery tube, where the melt delivery tube is communicated to a bottom of the crucible body via the nozzle flange body; inductively heating an active metal material rod inside the crucible body, to produce a melt formed with a melting skull; measuring a temperature of a boundary of the nozzle flange body which is close to the melt; and inductively heating the nozzle flange body and controlling the temperature of a boundary of the nozzle flange body to reach a predetermined temperature according to the measured temperature of the boundary of the nozzle flange body, wherein: when the temperature of the melting skull of the melt is more than the temperature at which the nozzle flange body reacts with the melt to produce a compound, the predetermined temperature is less than and close to the temperature at which the nozzle flange body reacts with the melt to produce a compound, and the predetermined temperature is more than a temperature obtained after subtracting the temperature of the melting skull of the melt by 200 degrees Celsius; and when the temperature of the melting skull of the melt is less than the temperature at which the nozzle flange body reacts with the melt to produce a compound, the predetermined temperature is less than the temperature of the melting skull of the melt, and the predetermined temperature is more than the temperature obtained after subtracting the temperature of the melting skull of the melt by 200 degrees Celsius.

If the temperature of the melting skull of the melt (for example, titanium) is more than the temperature at which the nozzle flange body (for example, graphite) reacts with the melt to produce a compound, preferably, the predetermined temperature is less than and close to the temperature at which the nozzle flange body reacts with the melt to produce a compound. The temperature of the boundary of the nozzle flange body (controlled as the predetermined temperature) is controlled to be less than the temperature at which the nozzle flange body reacts with the melt to produce a compound, and therefore the predetermined temperature of the nozzle flange body can prevent the nozzle flange body from reacting with the melt to produce a compound, thereby guaranteeing the quality of the melt.

If the temperature of the melting skull of the melt (for example, titanium) is less than the temperature at which the nozzle flange body (for example, tungsten steel) reacts with the melt to produce a compound, preferably, the predetermined temperature is less than and close to the temperature of the melting skull of the melt. The predetermined temperature is less than and close to the temperature of the melting skull of the melt, and therefore, the curve of the melting skull of the melt can become closer to two sides of the nozzle flange body. The utilization rate of the melt is increased when the curve of the melting skull of the melt becomes closer to the two sides of the nozzle flange body.

The above merely describes implementations or embodiments of technical means employed by the present disclosure to solve the technical problems, which are not intended to limit the patent implementation scope of the present disclosure. Equivalent changes and modifications in line with the meaning of the patent scope of the present disclosure or made according to the scope of the invention patent are all encompassed in the patent scope of the present disclosure.

What is claimed is:

1. A crucible device with temperature control design, wherein the crucible device comprises:

a crucible body;

an induction coil unit, surrounding the crucible body, providing a heat source during use, and configured to enable a metal material to melt and produce a melt having a melting skull;

a nozzle flange body and a melt delivery tube, wherein the melt delivery tube is communicated to a bottom of the crucible body via the nozzle flange body, and is configured to deliver the melt from the crucible body; and a temperature control unit, comprising a microprocessor, a heater, and a temperature sensor that are electrically coupled to each other, wherein:

the temperature sensor is configured to measure a temperature of a boundary of the nozzle flange body which is close to the melt, the heater is configured to inductively heat the nozzle flange body, and the microprocessor adjusts a power of the heater according to the measured temperature of the boundary of the nozzle flange body, so as to control the temperature of the boundary of the nozzle flange body to reach a predetermined temperature, and to further control a curve of the melting skull to drop to a preset position.

2. The crucible device with temperature control design according to claim 1, wherein the nozzle flange body is made of graphite or tungsten steel.

3. The crucible device with temperature control design according to claim 1, further comprising:

a heat insulation ring, located between the crucible body and the nozzle flange body, and configured to alleviate heat dissipation of the nozzle flange body to the crucible body.

4. The crucible device with temperature control design according to claim 3, wherein the temperature control unit further comprises a cooling water passage, configured to remove heat from the nozzle flange body.

5. The crucible device with temperature control design according to claim 1, wherein the temperature sensor is a thermo couple, the thermo couple being directly embedded in the nozzle flange body; and the heater is a power-adjustable induction coil.

6. A temperature control method for a crucible device, comprising the following steps of:

providing a crucible body, a nozzle flange body, and a melt delivery tube, wherein the melt delivery tube is communicated to a bottom of the crucible body via the nozzle flange body;

inductively heating an active metal material rod inside the crucible body, to produce a melt formed with a melting skull;

measuring a temperature of a boundary of the nozzle flange body which is close to the melt; and inductively heating the nozzle flange body according to the measured temperature of the boundary of the nozzle flange body, and controlling the boundary of the nozzle flange body to reach a predetermined temperature, wherein:

when a temperature of the melting skull of the melt is more than a temperature at which the nozzle flange body reacts with the melt to produce a compound, the predetermined temperature is less than the temperature at which the nozzle flange body reacts with the melt to produce a compound; and when a temperature of the melting skull of the melt is less than a temperature at which the nozzle flange body reacts with the melt to produce a compound, the predetermined temperature is less than the temperature of the melting skull of the melt.

7. The temperature control method for a crucible device according to claim 6, wherein the nozzle flange body is made of graphite, the temperature of the melting skull of the melt is more than the temperature at which the nozzle flange body reacts with the melt to produce a compound, and the predetermined temperature is less than and close to the temperature at which the nozzle flange body reacts with the melt to produce a compound.

8. The temperature control method for a crucible device according to claim 7, wherein the melt is a titanium melt, and the predetermined temperature is less than and close to 1050 degrees Celsius.

9. The temperature control method for a crucible device according to claim 6, wherein the nozzle flange body is made of tungsten steel, the temperature of the melting skull of the melt is less than the temperature at which the nozzle flange body reacts with the melt to produce a compound, and the predetermined temperature is less than and equal to the temperature of the melting skull.

10. The temperature control method for a crucible device according to claim 9, wherein the melt is a titanium melt, and the predetermined temperature is less than and close to 1200 degrees Celsius.

* * * * *